United States Patent [19]

Meinander

[11] Patent Number: 5,018,478

[45] Date of Patent: May 28, 1991

[54] METHOD AND APPARATUS FOR COATING A PAPER WEB

[75] Inventor: Paul O. Meinander, Grankulla, Finland

[73] Assignee: A. Ahlstrom Corporation, Karhula, Finland

[21] Appl. No.: 269,531

[22] PCT Filed: Jun. 12, 1988

[86] PCT No.: PCT/FI88/00092

§ 371 Date: Nov. 8, 1988

§ 102(e) Date: Nov. 8, 1988

[87] PCT Pub. No.: WO88/09700

PCT Pub. Date: Dec. 15, 1988

[30] Foreign Application Priority Data

Jun. 12, 1987 [FI] Finland ..... 872616

[51] Int. Cl.[5] ..... B05C 3/132

[52] U.S. Cl. ..... 118/410; 118/411

[58] Field of Search ..... 118/410, 411

[56] References Cited

U.S. PATENT DOCUMENTS

| | | | |
|---|---|---|---|
| 4,354,452 | 10/1982 | Patterson | 118/413 |
| 4,398,494 | 8/1983 | Alheid | 118/410 |
| 4,426,412 | 1/1984 | Gebert et al. . | |
| 4,434,194 | 2/1984 | Gebert et al. | 118/410 |
| 4,440,105 | 4/1984 | Jelfema | 118/410 |
| 4,440,809 | 4/1984 | Vreeland | 427/356 |
| 4,503,804 | 3/1985 | Damrau | 118/410 |
| 4,836,133 | 6/1989 | Wohrle | 118/413 |

FOREIGN PATENT DOCUMENTS

| | | |
|---|---|---|
| 3438181 | 4/1986 | Fed. Rep. of Germany . |
| WO87/00091 | 1/1987 | PCT Int'l Appl. . |

*Primary Examiner*—Shrive Beck

*Attorney, Agent, or Firm*—Nixon & Vanderhye

[57] ABSTRACT

Method and apparatus for coating a paper or paper board web including preventing deposition and drying of the coating paste on the edge zones of the coating chamber by continuously causing a flow of coating paste from the coating chamber past the edge seal (2). Each edge seal is disposed in the space between the front and the rear walls (3,4) of the coating apparatus, and the upper part (11) of each edge seal corresponds to the form of a wedge between the wiping member (9) of the coating apparatus and the web (12) to be coated. Coating paste flows through gaps (13, 14) between the edge seals and the wiping member and between the edge seals and the web, which gaps are for example, between about 2-5 mm wide.

15 Claims, 2 Drawing Sheets

METHOD AND APPARATUS FOR COATING A PAPER WEB

Figure 1:
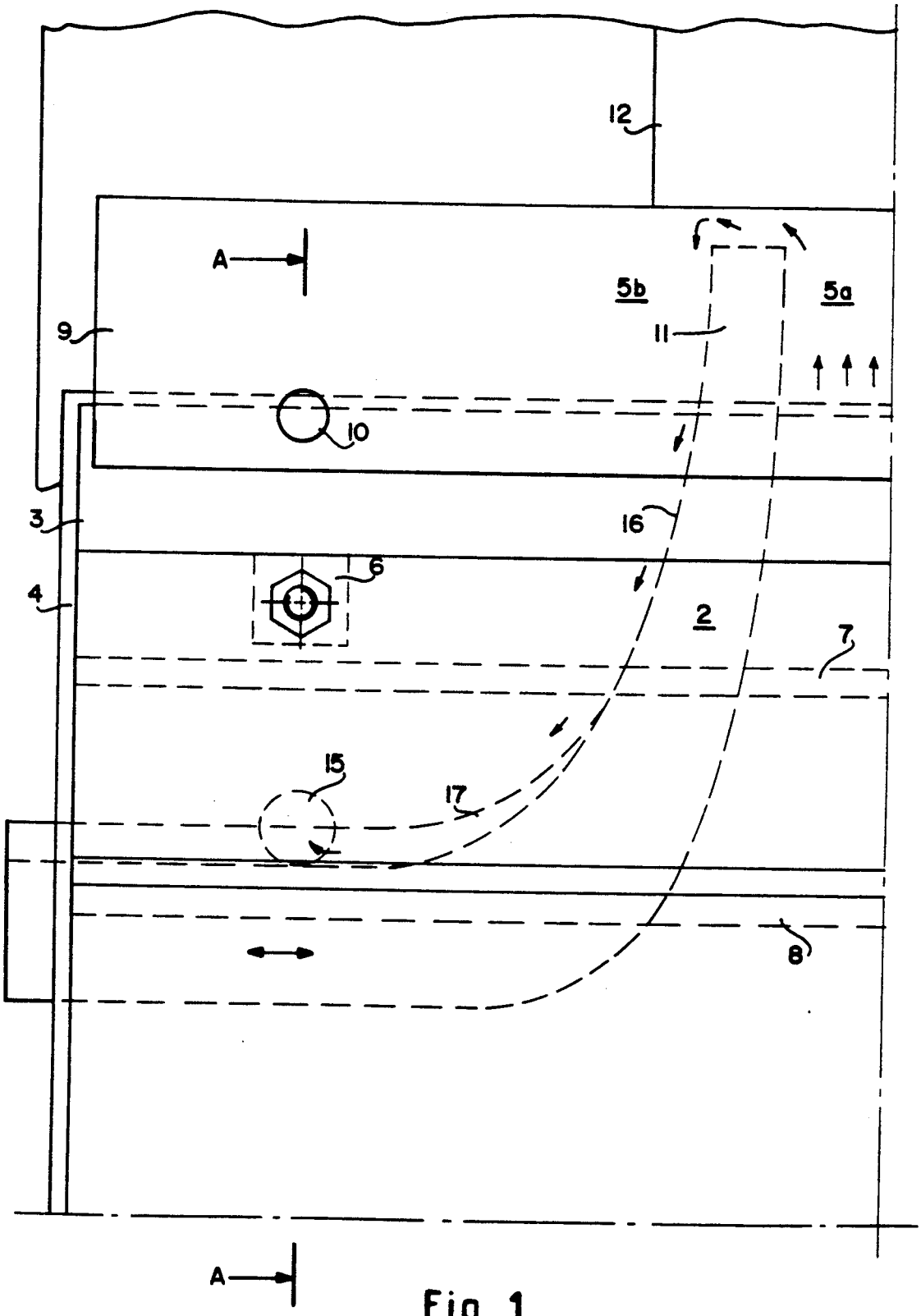

The present invention relates to a method of coating a paper web utilizing a coating apparatus, having a pressurized coating chamber in communication with the web to be coated.

The invention also relates to an apparatus for coating a moving paper web, including a pressurizable coating chamber to be filled with a coating paste, substantially of a width equal to that of the web, and which chamber, in use, communicates with said web. The coating chamber is defined by the web, on the inlet side by the rear wall of the coating apparatus and on the outlet side by the front wall of the coating apparatus as well as by a wiper arranged at the upper part of the front wall for removing excess coating paste.

Coating apparatuses with a pressurized coating chamber, e.g. so called short dwell coaters, have an elongate opening through which the coating paste comes into contact with the web. The coating zone is sealed on the inlet side of the web by the rear wall of the coating apparatus or by some other sealing wall. At the outlet side of the web the wiping member prevents the free flow of the coating paste from the coating zone. The edges of the coating zone are sealed by edge seals or edge limiters in order to prevent the coating paste from flowing out from the edges of the apparatus.

The edge seals in the pressurized coating apparatuses cause problems. It has been found difficult to provide sealing devices which operate satisfactorily and reliably. Some of the coating paste remains on the edge zones, dries and causes running problems in the coating, breaks and cleaning operations. Additionally, the coated paper in the edge zones is of bad quality and cannot, therefore, be fully utilized.

The main direction of developments in attempting to deal with the problems has been to minimize the leakages of coating paste at the edge seals. For example, Finnish patent 72902 discloses a throttling member arranged to improve the sealing effect of the edge seal. As a consequence of this, the coating paste which has reached the coating zone does not immediately meet the edge seal, the result of which is that the coating pulp at the edge seal remains substantially stationary and the leak of coating paste through the edge seal is minimized.

Finnish patent application 854053 discloses an arrangement which tends to minimize the overflow of the coating paste with a two-piece edge seal. The overflow gap can thus be reduced to considerably less than 1.5–2 mm so that only little paste escapes from the overflow gap.

U.S. Pat. No. 4,354,452 discloses a soft edge seal, which eliminates or minimizes the overflow of the coating paste. The edge seal comprises a soft member, which when filled with air or liquid seals the end area of the coating zone.

The elimination of the problems has not been entirely successful in the above-mentioned mechanical constructions. The solutions have proved less successful in practice, while the basic problems, i.e. uneven coating at the edge areas and disturbances in the coating process still remain unsolved, because in the coating chamber, in the edge zone of the freely flowing coating paste and the slow coating paste at the edges, deposition of paste, thickening and drying take place.

The application of coatings to paper webs of different width has also been difficult.

One object of the present invention is to avoid or minimize the above-mentioned deficiencies and to provide even better coating conditions, by means of which the slowing down of the coating paste flow at the edge areas and problems caused by the slower, thicker paste are avoided or minimized.

Another object of the invention is to provide an improved coating apparatus with better operating qualities, wherein the coating paste flows optimally also at its edge zones.

Yet another object of the invention is to provide a coating apparatus which is applicable according to the width of the web and with which variations in the width of the web can be taken into account and the web can be optimally utilized.

Recently it has been discovered that too careful a sealing of the coating chamber is harmful. The invention presents a method and apparatus which can prevent or minimize the thickening of the coating paste and the deposition of the coating paste caused by drying on the edge zones.

The aims of the invention, i.e. better coating conditions, can be achieved by adjusting the coating chamber according to the width of the paper web by arranging an edge seal at both edge zones of the coating chamber and preventing the deposition and drying of the coating paste at the edge zones of the coating chamber by means of a continuous outflow of coating paste from the coating chamber, through the gap between the edge seal and the web and/or the edge seal and the wiping member.

A coating apparatus according to the invention is characterized in that at both edge zones of the coating chamber there is an edge seal substantially of the same thickness as the space between the front and the edge wall. The upper part of the edge seal is designed substantially in the form of a wedge between the wiping member and the web and disposed in the coating area so as to form a gap of, for example, 2–5 mm, preferably about 3 mm, between both the wedge-like upper part and the web and the wedge-like upper part and the wiping member to enable a continuous flow of coating paste from the coating chamber to the outside of the edge seal. At least one end seal is preferably adjustably displaceable sideways in the lateral direction of the web to provide the optimal coating according to the width of each paper web.

A continuous flow of coating paste past the edge seal creates a flushing effect at the edge zones and prevents the drying of the coating paste in the coating chamber.

Figure 2:
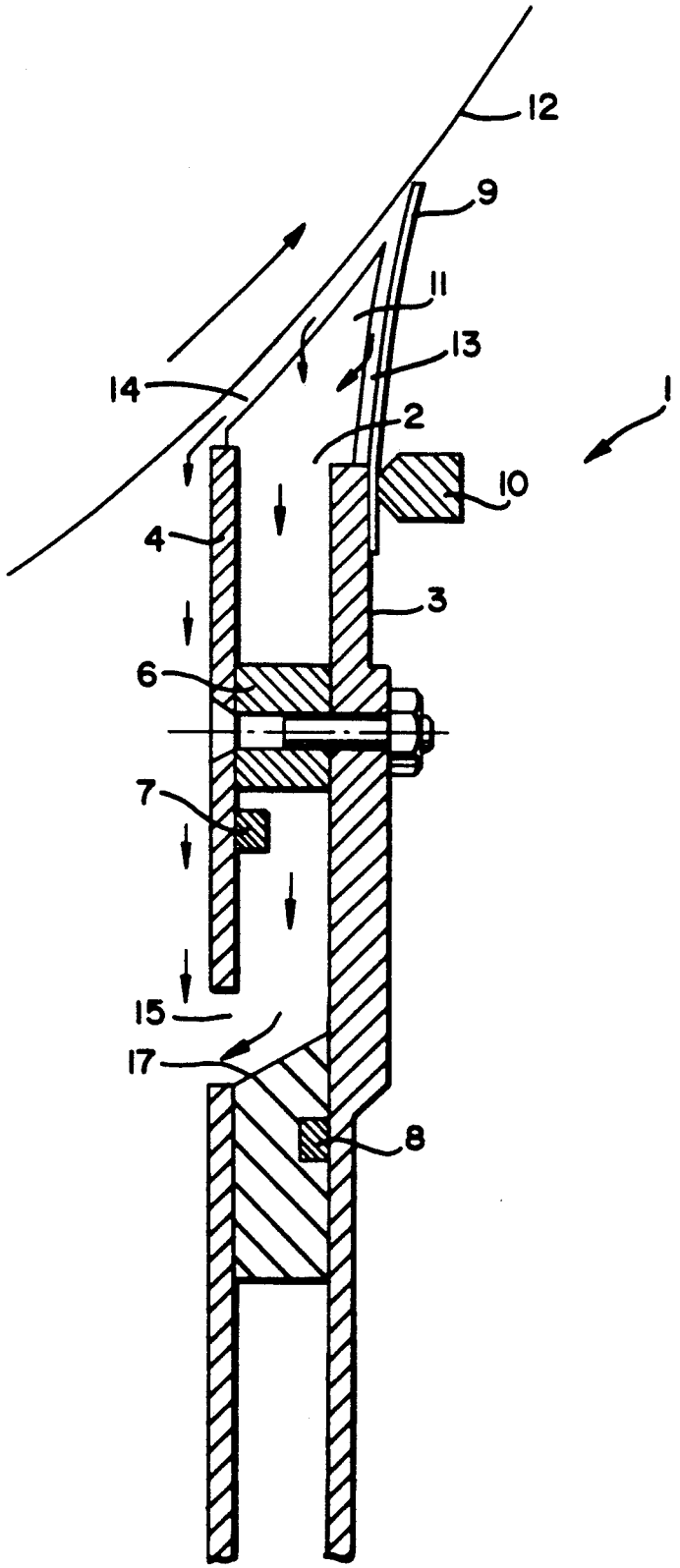

The invention is described in detail, by way of example, below with reference to the accompanying drawings, in which:

FIG. 1 is a fragmentary illustration of the left-hand edge zone as viewed of part of a coating apparatus with edge seal means according to the invention at each edge; and FIG. 2 is a sectional view of the edge zone shown in FIG. 1 along the line A—A—the other edge zone of the coating apparatus corresponds.

FIGS. 1 and 2 show the left-hand edge zone as viewed of a coating apparatus 1 (only a part of which is shown), wherein an edge seal 2 according to the invention is arranged in a coating chamber 5 between front wall 3 and rear wall 4. The edge seal divides the coating chamber into inlet duct 5*a* for the coating paste and a return duct 5*b* for the coating paste. The edge seal is substantially of the same thickness as the distance between the front wall 3 and the rear wall 4. An intermediate adjusting element 6 determines the distance between the front wall and the rear wall. Each edge seal can be moved in the lateral direction supported by a bar like guiding member 7 arranged on the rear wall and another bar like guiding member 8 arranged on the front wall.

A blade 9 extending across the machine is attached on the upper part of front wall 3 of the coating apparatus to wipe away excess coating paste An adjustable pressure element 10 fixes the wiping blade to the front wall.

The upper part 11 of the edge seal 2 is formed corresponding to the wedge-like space between the web 12 to be coated (and an edge of which is indicated) and the wiper blade 9. Gaps 13 and 14 are formed between the free portion of the wiper blade 9 and the upper part of the edge seal 11 and between the moving web 12 and the upper part of the edge seal to enable a continuous flow of coating paste from the inlet duct 5*a* of the coating chamber to the return duct 5*b* of the coating chamber A gap of 1–10 mm enables sufficient overflow of coating paste according to the coating material from the coating duct to the return section.

The upper part of the edge seal is advantageously of such width that the gaps 13, 14 will not be too long, whereby the returning coating paste flow would slow down too much or moreover be entirely hindered. The lower part of the edge seal advantageously widens changing the originally vertical outer surface 16 of its lower part to a substantially horizontal surface, as can be seen in the drawing. The coating paste returning from the gaps 13,14 is led along the outer surface 16 of the edge seal firstly flowing down and thereafter out of the coating apparatus. At its lowest part the outer surface of the edge seal changes to a surface 17 inclined down towards the rear wall. In the rear wall 4 there is an opening 15 at the level of the inclined part of the edge seal to lead the returning coating paste out of the coating apparatus. Coating paste can be led through a paste container back to the coating duct 5*a*; this is not shown in the drawings. Drying of the coating paste can easily be avoided in an open return section by injecting water to the coating paste flowing down along the outer surface 16 of the edge seal.

In the coating process an even coating paste flow meets the moving paper, or e.g. paper board, web. The paste follows the web. The wiper blade, bar or like wiping device wipes off excess coating paste from the web. Coating paste is discharged over the whole width of the web and also through the gap between the web and the coating apparatus. Additionally, coating paste flows out at the edges through the gaps between the edge seals and the web and between the edge seals and the wiping member. The coating paste flow in the coating duct is even and the coating result is therefore also even throughout the whole width of the web.

The invention is not restricted to the above shown embodiment, but several variations of it are possible within the scope of the accompanying claims. The invention can be applied to different types of coating apparatuses, also to two-sided coating.

We claim:

1. A coating apparatus for coating a paper web comprising:

a pressurized coating chamber having substantially the same width as said web, said chamber being fillable with a coating paste and disposed to communicate said paste to said web;

said chamber defined by said web, a rear wall aligned with the inlet side of said web, a front wall aligned with the discharge side of said web and opposite to said rear wall, and a wiping blade on the upper portion of said front wall;

an edge seal of substantially the same thickness as the space between said front and rear walls, an upper portion of said seal forming a wedge between said wiping blade and said web; and a first gap between said upper seal portion and said web and a second gap between said upper seal portion and said wiping blade, each of said gaps being continuously open to outflow of said paste from said chamber to create a continuous flushing effect at said edge seal and prevent the drying of coating paste in said coating chamber, said first and second gaps being each at least 1 mm.

2. The coating apparatus according to claim 1 further comprising a guide in either said front or rear wall and parallel to said web, said edge seal riding transversely in said guide.

3. The coating apparatus according to claim 2 in which said guide is in both said front and rear walls.

4. The coating apparatus according to claim 1 in which said edge seal is mounted for movement to thereby vary the dimension of said first gap.

5. The coating apparatus according to claim 1 in which said wiping blade is mounted for movement to thereby vary the dimension of said second gap.

6. The coating apparatus according to claim 1 wherein said blade projects from an edge of said front wall, the second gap being continuously open between the edge of the front wall and the distal end of said upper wedge forming portion.

7. The coating apparatus according to claim 1 further comprising an opening in said rear wall positioned to receive said paste flowing down said edge seal.

8. A coating apparatus for coating a paper web comprising:

a pressurized coating chamber having substantially the same width as said web, said chamber being fillable with a coating paste and disposed to communicate said paste to said web;

said chamber defined by said web, a rear wall aligned with the inlet side of said web, a front wall aligned with the discharge side of said web and opposite to said rear wall, and a wiping blade on the upper portion of said front wall, said blade projecting from an edge of said front wall;

an edge seal of substantially the same thickness as the space between said front and rear walls, an upper portion of said seal forming a wedge between said wiping blade and said web; and a first gap between said upper seal portion and said web and a second gap between said upper seal portion and said wiping blade, each of said gaps being continuously open to outflow of said paste from said chamber to create a continuous flushing effect at said edge seal and prevent the drying of coating paste in said coating chamber, said second gap being continuously open between the edge of the front wall and the distal end of said upper wedge forming portion.

9. The coating apparatus according to claim 8 wherein each of said first and second gaps is at least 1 mm.

10. The coating apparatus according to claim 8 further comprising an opening in said rear wall positioned to receive said paste flowing down said edge seal.

11. The coating apparatus according to claim 8 further comprising a guide in either said front or rear wall and parallel to said web, said edge seal riding transversely in said guide.

12. The coating apparatus according to claim 11 in which said guide is in both said front and rear walls.

13. The coating apparatus according to claim 8 in which said edge seal is mounted for movement to thereby vary the dimension of said first gap.

14. The coating apparatus according to claim 8 in which said wiping blade is mounted for movement to thereby vary the dimension of said second gap.

15. A coating apparatus for coating a paper web comprising:

a pressurized coating chamber having substantially the same width as said web, said chamber being fillable with a coating paste and communicates said paste to said web;

said chamber defined by said web, a rear wall aligned with the inlet side of said web, a front wall aligned with the discharge side of said web and opposite to said rear wall, and a wiping blade on the upper portion of said front wall;

an edge seal of substantially the same thickness as the space between said front and rear walls, an upper portion of said seal forms a wedge between said wiping blade and said web;

a first gap between said upper seal portion and said web and a second gap between said upper seal portion and said wiping blade, said gaps being open to the continuous flow of said paste; and an intermediate adjustor means disposed between said front and rear walls for maintaining a certain distance between said walls.

* * * * *